United States Patent [19]

Fung

[11] Patent Number: 4,840,040

[45] Date of Patent: Jun. 20, 1989

[54] ISLAND TYPE REFRIGERATION DISPLAY CABINET

[75] Inventor: Kwok K. Fung, Niles, Mich.

[73] Assignee: American Standard Inc., New York, N.Y.

[21] Appl. No.: 247,543

[22] Filed: Sep. 22, 1988

[51] Int. Cl.[4] ..... A47F 3/04

[52] U.S. Cl. ..... 62/255; 198/36

[58] Field of Search ..... 62/256, 255; 98/36

[56] References Cited

U.S. PATENT DOCUMENTS

| | | | |
|---|---|---|---|
| Re. 31,909 | 6/1985 | Ibrahim | 62/82 |
| 2,794,325 | 6/1957 | Shearer | 62/256 X |
| 2,855,762 | 10/1958 | Zehnder | 62/252 |
| 3,130,559 | 4/1964 | Beckwith | 62/256 |
| 3,359,755 | 12/1967 | Creech | 62/441 |
| 4,337,626 | 7/1982 | Ibrahim | 62/82 |
| 4,399,662 | 8/1983 | Ibrahim | 62/82 |
| 4,408,465 | 10/1983 | Ibrahim | 62/82 |
| 4,439,992 | 4/1984 | Ibrahim | 62/82 |
| 4,483,153 | 11/1984 | Wallace | 62/256 |
| 4,633,677 | 1/9187 | Maehara | 62/256 |
| 4,648,247 | 3/1987 | Takizawa et al. | 62/256 |
| 4,723,414 | 2/1988 | Hurutachi et al. | 62/155 |

FOREIGN PATENT DOCUMENTS

| | | | |
|---|---|---|---|
| 719434 | 10/1965 | Canada | 62/256 |

*Primary Examiner*—William E. Tapolcai

*Attorney, Agent, or Firm*—William J. Beres; David L. Polsley; Robert J. Harter

[57] ABSTRACT

In an island type refrigeration display cabinet, a top aperture containing two oppositely disposed louvers for discharging oppositely directed coplanar air curtain sections, to form a single air curtain of multiple section in the top aperture of the display cabinet. Preferably, the cabinet also includes means for withdrawing air from the interior display space of the cabinet and forcing the air through a bifurcated conduit. Each bifurcation of the conduit is flowably connected to one of the respective louvers in the top opening of the display cabinet. Each bifurcation of the conduit also includes means for refrigerating the air flowing through the conduit to the louvers.

14 Claims, 4 Drawing Sheets

ISLAND TYPE REFRIGERATION DISPLAY CABINET

TECHNICAL FIELD

This invention generally pertains to a refrigerated display cabinet and particularly to island type refrigeration display cabinets having an air curtained access opening.

BACKGROUND ART

The typical refrigeration display case is comprised of a cabinet having an interior display space for displaying comestibles which must be refrigerated to prevent spoilage or deterioration of quality or edibility. Typically, such refrigeration display cases are of two types. Both types generally include a means for refrigerating air in the interior display space while attempting to permit ready access and removal of those comestibles displayed.

The first type of refrigeration display cabinet typically includes an access opening covered by a movable door or similar member. This door generally includes a transparent portion comprised of one or more thermally insulating panes. This door prevents intermixing of environmental air found outside the refrigerated display case with the refrigerated air cooled inside the display space to minimize the warming effect of the environmental air upon the cooled air in the display space. However, as these refrigeration display cases are typically located in supermarkets and grocery stores where the door must be frequently opened, the effectiveness of the door in preventing air intermixing is somewhat limited. Furthermore, persons attempting to retrieve comestibles from the interior display space of the refrigeration cabinet are required to open and close the door member, which is often heavy and unwieldy. This design furthermore has the disadvantage of requiring a number of components which in turn increases the cost and maintenance of the unit.

The second typical refrigeration display case includes a cabinet having at least one wall with an access opening to an interior display space defined within the refrigeration cabinet. This access opening typically has at least one air curtain disposed across the access opening, flowing from an outlet in one side of the access opening to an inlet in the opposite side of the access opening. The air curtain is best defined as a strata of air of a given temperature and velocity bounded by air of relatively different temperature and velocity. The air curtain may range in thickness, for example, from 2 to 4 inches and in velocity from 2 to 13.5 feet per second. Due to the distance which must be traversed by the air curtain, it has been found that the air curtain often suffers from deterioration at its boundries due to the entrainment of environmental air. Further, the air curtain often entrains an undesirable amount of moisture from the environmental air, as the environmental air is typically at a higher temperature and thus contains a larger quantity of water vapor in an equal volume of air than found in the air of the air curtain. Also, the air curtain suffers increasing deterioration and moisture entrainment in proportion to the distance it must traverse.

In order to minimize this entrainment and deterioration effects, it is typical to provide multiple air curtains directed concurrently such that the strata of the respective air curtains are parallel, adjacent and flow in the same direction. This configuration permits the interior air curtains to entrain relatively less environmental air and moisture, as the exterior air curtain is primarily exposed only to environmental air and, therefore, is the primary air curtain entraining the excess moisture. The air in the air curtains then re-enters a conduit within the cabinet and passes through a refrigeration evaporator for cooling to the desired temperature.

A disadvantage of the crossflow air curtain method arises in that the air in the air curtain having entrained excess moisture then deposits the excess moisture upon the refrigeration evaporator. This increases the defrost requirement, thus increasing the heat injected into the refrigeration cabinet and the refrigeration workload with associated increase in cost and decrease in efficiency. This problem has been dealt with in various systems by providing multiple evaporators, or providing switchable air conduits within the cabinet for directing flow alternately through different refrigeration evaporators. Systems such as these have an increased number of components with increased maintenance requirements, cabinet costs and complexity of construction. None of these systems deal satisfactorily with the problem of providing a satisfactory minimum air curtain length while at the same time providing an access opening of the maximum width for ease of consumer access to the comestibles contained in the refrigeration compartment.

Therefore, in consideration of the foregoing, it is an object of the invention to provide an island-type refrigeration display cabinet having a single, multi-sectional air curtain to provide maximum access opening size in such a cabinet.

It is another object of the invention to provide an island type refrigeration display cabinet having an air curtain having a low velocity and extending a minimum distance across the access opening to entrain a minimal amount of moisture.

It is still a further object of the invention to provide such a cabinet having a simple air flow circuit.

It is yet another object of the invention to provide an island-type refrigeration cabinet of relatively simple, inexpensive construction.

It is yet another object of the invention to provide an island-type refrigeration display cabinet to provide in such a cabinet a simple means of defrosting the included refrigeration system.

It is another object of the invention to provide such a cabinet as is simple of operation and maintenance.

These and other objects of the invention will be apparent from the attached drawings and the description of the preferred embodiment that follows herein.

SUMMARY OF THE INVENTION

The subject invention is an island-type refrigeration display cabinet having an interior display space, a top wall, a plurality of exterior walls and an internal refrigeration system. An air flow circuit is defined within the display cabinet by a return air conduit, which may be bifurcated to accept air at a plurality of points from the interior display space, a bifurcated conduit for directing air to a first louver disposed adjacent the top wall of the display cabinet and to a second louver disposed adjacent the top wall of the cabinet opposite the first louver. The return air conduit and the bifurcated conduit are in flow communication, with one or more fans disposed between the return air conduit and the bifurcated conduit for forcing air through the bifurcated conduit. The first and second louvers are coplanar and oppositely directed for causing a single, multisectional air curtain composed of two oppositely directed components. These oppositely directed components of the air curtain meet approximately in the center of the access opening in the top wall of the display cabinet, and are drawn into the interior display space and thence into the return air conduit by the fan. Thus, an air circuit is defined for providing a single air curtain of two sectional components flowing at relatively low velocity and relatively short distance to entrain only a small amount of environmental air and moisture. Preferably, the refrigeration system includes at least one evaporator disposed in the bifurcated conduit for cooling the air as it flows through the bifurcated conduit to the louvers.

DESCRIPTION OF THE PREFERRED EMBODIMENT

Figure 1:
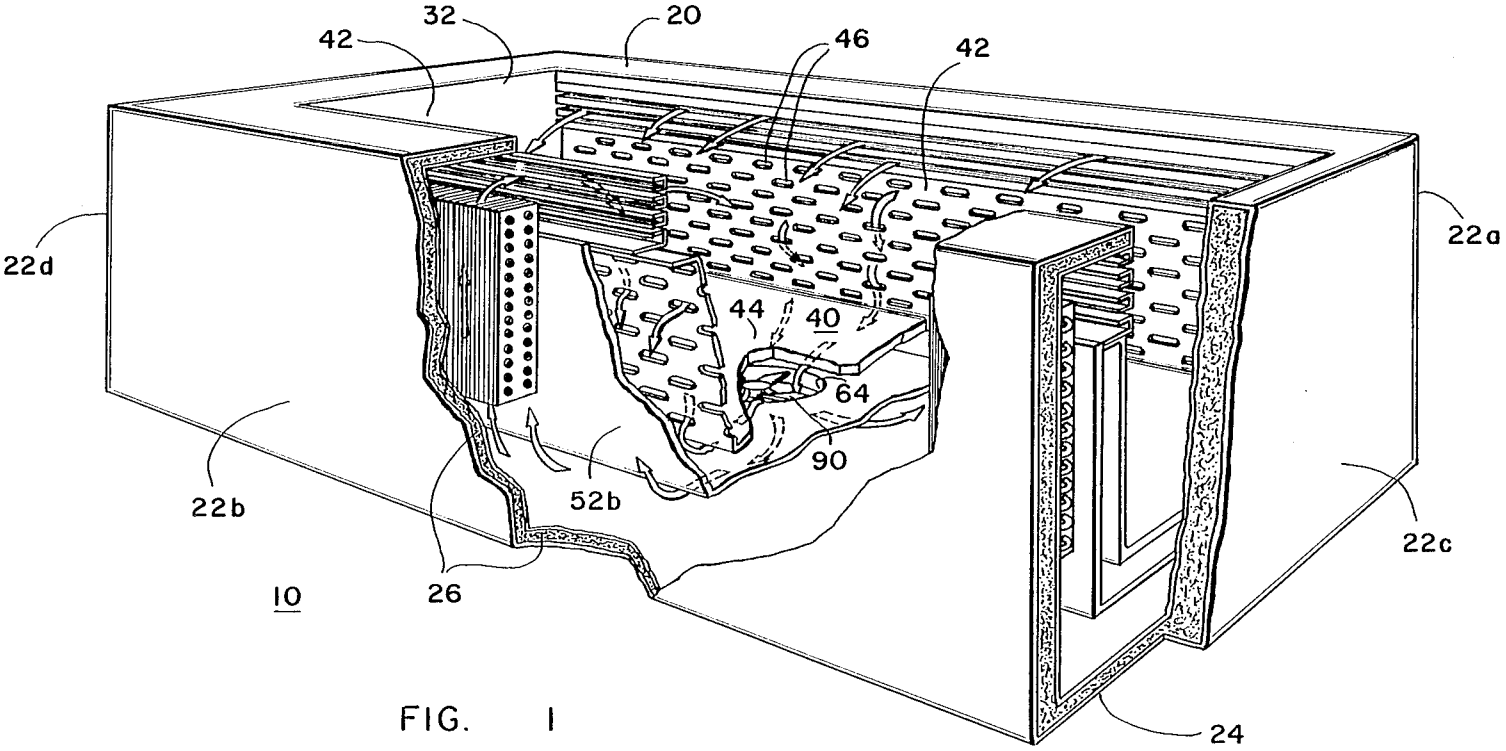
FIG. 1 shows a perspective view of an island-type refrigeration display case embodying the subject invention, visible in cutaway view.

An island-type refrigeration display cabinet generally denoted by reference numeral 10 is shown in FIG. 1. The cabinet 10 is preferably rectilinear in form, having a top wall 20, four side walls 22, and a bottom 24. An access opening 30 is provided in the top wall. The access opening 30 is rectilinear, described by four sides 32 which are parallel to the respective side walls 22 but of relatively smaller dimension. Thus, for example, if the exterior dimensions of the cabinet 10 defined by side walls 22 is 5 feet by 8 feet, then the dimensions of the access opening walls 32 will be on the order of 4 feet by 7½ feet. Preferably, the refrigeration display cabinet will have an overall height of the side walls 22 within the range of 28 to 40 inches, to permit a person standing beside the display cabinet 10 to easily reach through the access opening 30. The side walls should also be insulated with a foam insulation 26 to enhance the thermal efficiency of the cabinet 10 by reducing heat transfer through the exterior walls 20, 22 and 24.

The display cabinet 10 further includes an interior display space 40. This display space 40 is defined by four interior side walls 42 and an interior bottom panel 44. The dimensions of the interior side wall 42 will preferably correspond to the dimensions of the access opening walls 32. The interior bottom panel 44 is parallel to the bottom 24 and top wall 20, and is recessed within the cabinet 10 from the top wall 20 to a depth preferably within the range of 12 to 26 inches. A number of return air aperture 46, preferably a series of holes or elongate slots, are provided in interior side walls 42 for air flow communication from the interior display space 40.

In the space defined between the interior side walls 42 and the side walls 22 are intermediate side panels 52 in parallel spaced relationship. An intermediate bottom panel 54 is disposed in spaced, parallel relationship with the bottom panel 44 and the bottom 24 of the cabinet 10. The intermediate side panels 52 and the intermediate bottom panel 54 are connected to define a return air conduit 60 between the interior side walls 42, the interior bottom panel 44, the intermediate side panels 52 and the intermediate bottom panel 54. The return air conduit 60 is in air flow communication with the interior display space 40 through the return air apertures 46.

The intermediate side panels 52, the intermediate bottom panel 54, the side walls 22 and cabinet bottom 24 cooperate to define a bifurcated air supply conduit. At least one aperture 64 is provided in the intermediate bottom panel 54 for permitting air flow communication from the return air conduit 60 to the bifurcated conduit 62.

Figure 2:
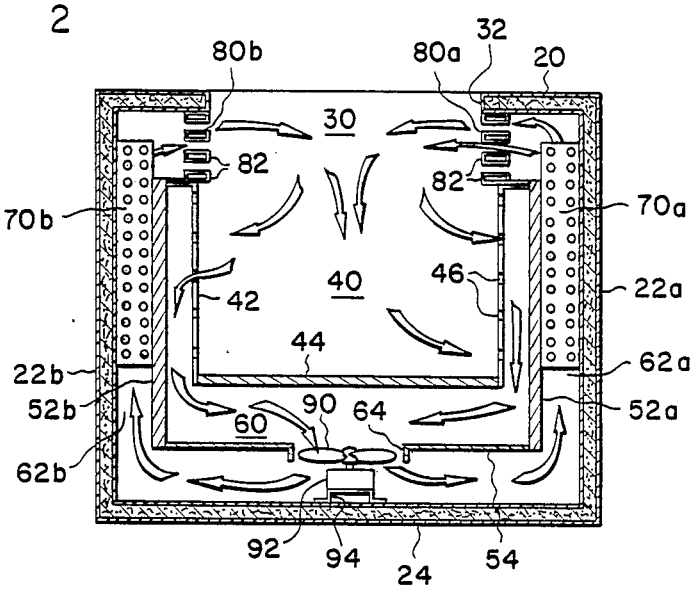
FIG. 2 is a cross-sectional view of the preferred embodiment of the refrigeration display cabinet of FIG. 1.

Turning now to FIG. 2 for a more detailed view of the cabinet 10, it can be seen that the bifurcated conduit 62 includes flow paths **62*a* and 62*b*. The bifurcated conduit portion 62*a* is defined by the cooperation of side wall 22*a* and intermediate side panel 52*a* and the bifurcated conduit portion 62*b* is defined by the side wall 22*b* and intermediate side panel 52*b*. A first evaporator 70*a* is disposed in the bifurcated conduit portion 62*a* and a second evaporator 70*b* is disposed in the second bifurcated conduit portion 62*b* as air passes through the bifurcated conduit 62, it passes through the evaporator 70 and is refrigerated. Each portion of the bifurcated conduit 62 extends to the top wall 20 of the cabinet 10, and terminates in a louver 80. Each louver 80 is comprised of a plurality of spaced parallel vanes 82, which may be horizontal tubular or planar elements. The louver 80*a* terminating the bifurcated conduit portion 62*a* is coplanar with the louver 80*b* terminating the bifurcated conduit portion 62*b***.

Preferably, crossflow fan 90 is rotatably disposed within the intermediate bottom panel aperture 64 for drawing air from the return air conduit 60 and forcing the air into the bifurcated supply air conduit 62. The crossflow fan 90 is connected to and driven in rotation by an electric motor 92, which in turn is secured by a support structure 94 to the bottom 24 of the cabinet 10. It would also be possible to include a plurality of fans 90, each having its own actuating electric motor 92, in a corresponding plurality of intermediate bottom panel apertures 64. Including a plurality of fans 90 would improve the operating reliability of the refrigeration display cabinet 10 be enabling continuous air flow in the event of the failure of one or more of the electric motors 92. Furthermore, a controller (not shown) may be included to permit selective actuation of one or more of the fans 90 by its corresponding electric motor 92 if desirable.

The construction and operational details specific to the fan 90, the electric motor 92 and the support structure 94 are not discussed in depth, as it is believed that these are well known in the art and not necessary to an understanding of the present invention. However, the crossflow fan 90 would generally include a plurality of vanes or blades affixed to an axle. The axle of the fan 90, in turn, would be secured to the rotor of the electric motor 92, a single or three phase motor as desired. The support structure 94 could be suitably formed from one or more pieces of sheet steel or aluminum, and secured to the motor 92 and the cabinet 10 by welding or by screws.

In operation, the electric motor 90 is actuated, rotating the fan 90 and withdrawing air from the interior display space 40 through the return air apertures into the return air conduit 60 as defined by the interior side walls 42 and the intermediate side panels 52. The fan 90 then forces the air through the intermediate bottom panel aperture 64 and into the branches of the bifurcated supply air conduit 62*a* and 62*b*. Air traversing the bifurcated conduit portion 62*a* is forced through and cooled in evaporator 70*a*, then discharged from the louver 80*a* in a planar strata directed toward the louver 80*b*, while air traversing the bifurcated conduit portion 62*b* is forced through and cooled in evaporator 70*b*, then discharged from the louver 80*b* in a planar strata directed toward the louver 80*a*. The two oppositely directed planar strata each comprising section of the resulting single air curtain then is drawn into the interior display space 40 to replace the air withdrawn at the beginning of the cycle and simultaneously cool the comestibles contained therein.

It should be noted that when the same part or feature is shown in more than one of the figures, it will be labeled with the corresponding reference numeral to aid in the understanding of the subject invention. Furthermore, reference should be had to all of the figures necessary to aid in the understanding of the specification even where a particular figure is referenced, as all reference numerals are not displayed in all figures in order to minimize confusion. When the same part of feature appears in a figure representing or disclosing an alternative embodiment of that part or feature, it is again labeled with the same reference numeral, followed by a numeric suffix to correspond with the designation of that alternative embodiment in the specification. The numeric suffix is intended to aid in the understanding of the embodiment and not to denote its value or order of preference.

Finally, it will be noted that since the display cabinet 10 is an island-type, the delineation of front and rear is arbitrary, and hence is denoted herein by suffixes "a" and "b", respectively.

Figure 3:
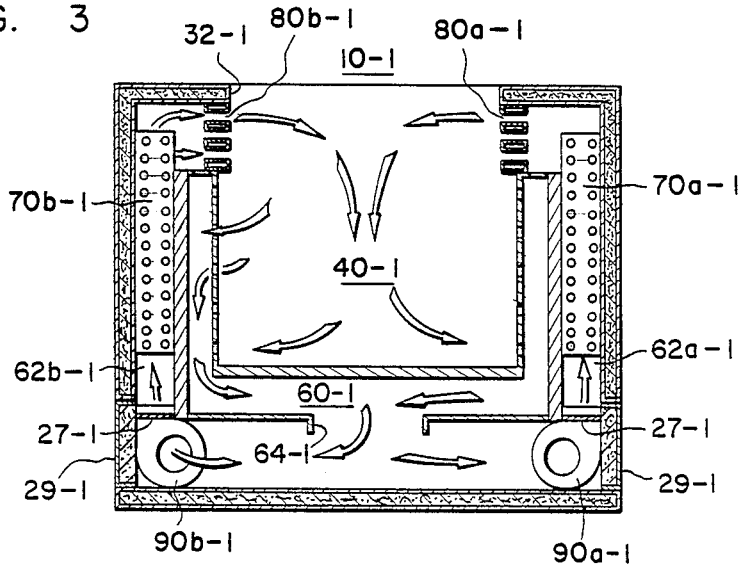
FIG. 3 is a cross-sectional view of an alternative embodiment of the refrigerated display cabinet of FIG. 1.

A first alternative embodiment is shown in FIG. 3. At least two centrifugal fans 90*a*-1 and 90*b*-1 are shown disposed in respective bifurcated conduit portions 62*a*-1 and 62*b*-1. The centrifugal fan 90*a*-1 is located in the corner of the bifurcated conduit 62*a*-1 formed by the juncture of the exterior cabinet side wall 22*a*-1 and the cabinet bottom 24-1, while the centrifugal fan 90*b*-1 is located in the corner of the bifurcated conduit 62*b*-1 formed by the juncture of the exterior cabinet side wall 22*b*-1 and the cabinet bottom 24-1. A baffle 27-1 is included in the conduit 62-1 to cause the air to be drawn into the fans 90-1 and to prevent backflow of air within the conduit 62-1. The baffle 27-1 is preferably co-planar with the intermediate bottom panel 54-1.

The centrifugal fans 90*a*-1 and 90*b*-1 are thus readily accessible through access panels 29-1 in the exterior side walls 22-1. In the event of the operational failure of one fan 90-1, the other fan 90-1 could provide a continued air flow within the cabinet 10-1 to maintain the temperature within the cabinet 10-1 while maintenance of the failed fan 90-1 could be completed. Operation of the cabinet 10-1 is substantially the same in all other respects as that of the preferred embodiment.

Figure 4:
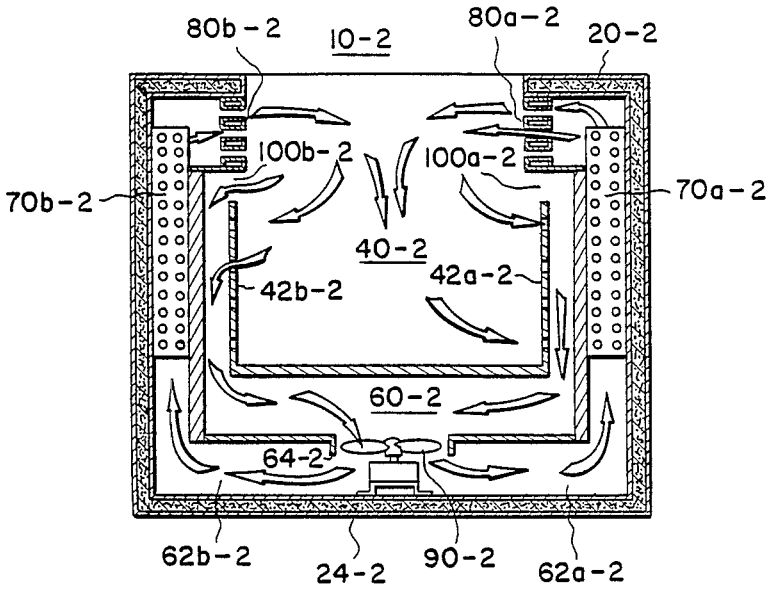
FIG. 4 is a cross-sectional view of yet another alternative embodiment of the refrigerated display cabinet of the subject invention.

FIG. 4 shows another alternative embodiment of the subject invention in a cabinet 10-2. The cabinet 10-2 includes two primary air return slots 100-2, one primary air return slot 100*a*-2 defined in the interior side wall 42*a*-2 adjacent to louver 80*a*-2 and a second primary air return slot 100*b*-2 defined in the interior side wall 42*b*-2 adjacent to louver 80*b*-2. These primary air return slots 100-2 provide an enhanced air return capability in the cabinet 10-2 when the interior display space 40-2 is filled. Operation of the cabinet 10-2 is substantially the same in all other respects as that of the preferred embodiment.

Figure 5:
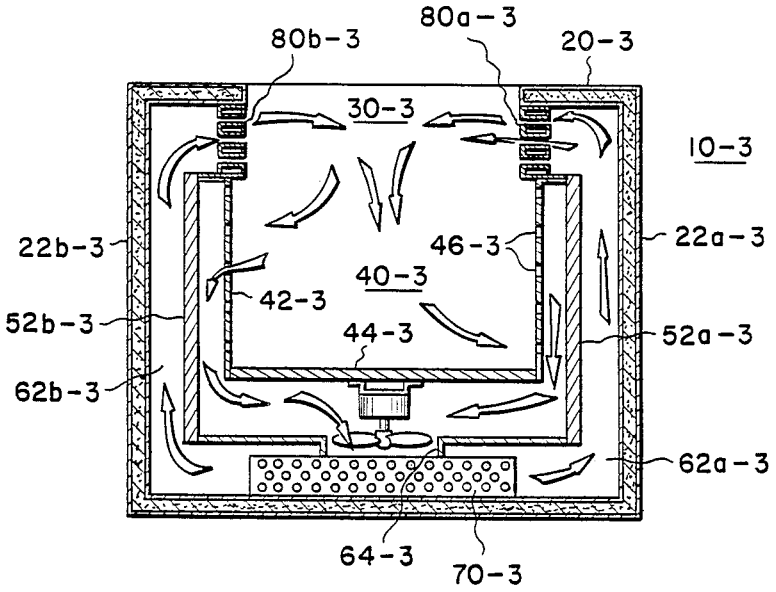
FIG. 5 shows a cross-sectional view of yet a third alternative embodiment of the refrigerated display cabinet of the subject invention.

A third alternative embodiment of the display cabinet 10-3 is shown in FIG. 5. This embodiment incorporates a single evaporator 70-3 disposed immediately adjacent the intermediate bottom panel aperture 64-3. The fan 90-3 is disposed in the aperture 64-3 as in the preferred embodiment, but the electric motor 92-3 and the corresponding support structure 94-3 depend from the interior bottom panel 44 or, alternatively, from the intermediate bottom panel 54 (not shown).

In operation, the single evaporator 70-3 refrigerates air forced through the intermediate bottom panel aperture 64-3 and divides the airflow into the bifurcated conduits 62*a*-3. This provides the advantage of utilizing a single evaporator 70-3 to obtain the same advantages as that of the preferred embodiment in operation while reducing manufacturing costs and the number of components in the cabinet 10-3.

Figure 6:
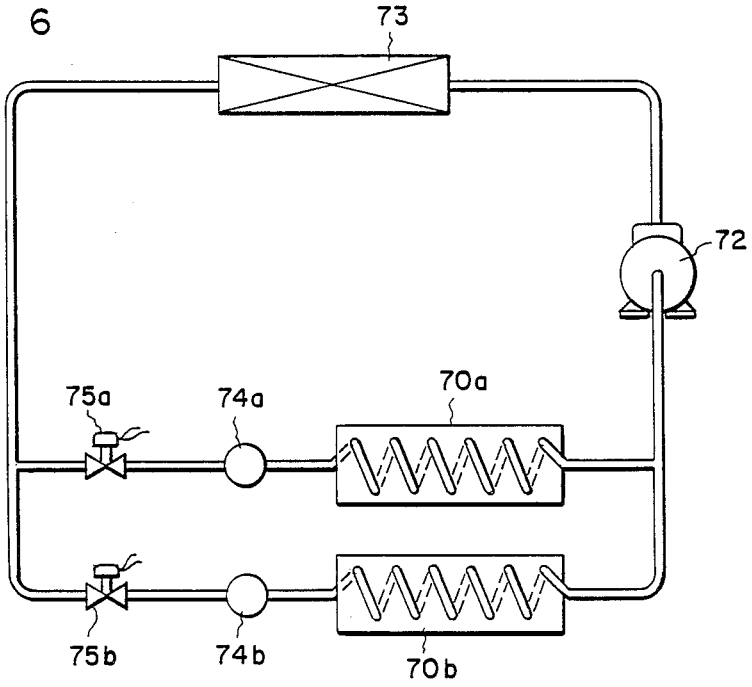
FIG. 6 is a schematic representation of a refrigeration system suitable for use in the refrigerated display cabinet of the subject invention.

FIG. 6 shows in schematic representation a typical refrigeration system suitable for use in a cabinet 10 embodying the subject invention. The evaporators 70 are in flow communication with a compressor 72 for compressing refrigerant from the evaporator 70 and directing the refrigerant to at least one condenser 73. As heat is lost from the refrigerant in the condenser 73, the refrigerant changes from the gaseous state to the liquid state and flows from the condenser 73 to an expansion valve 74. In the expansion valve 74, the refrigerant is expanded and then directed to the evaporators 70*a* and 70*b* which are disposed for parallel flow of the refrigerant. A shut off valve 75 is connected to each respective evaporator 70*a* and 70*b* for selectively preventing flow through each of the evaporators 70. Preferably, a controller 76 is included in the refrigeration system to operate the shut off valves 75*a* and 75*b*. When the shut off valves 75 are in the closed, flow preventing condition, the evaporator 70*a* and 70*b* may then be defrosted by operating the fan 90 to force air through the evaporators.

Only the evaporators 70 and a portion of the piping (not shown) for connecting the evaporators 70 need be emplaced in the cabinet 10, as such refrigeration systems as described herein typically include condensor 73 and compressor 72 racks remotely installed from the cabinet 10 which serve a number of similar refrigerated cabinets. Such installations need not be described in detail, as it is believed that they are well known to those acquainted with the art.

In the preferred embodiment, defrosting the evaporators 70 involves simple operating the fan 90 when the refrigeration system is not operating or when the shut off valves 75 are closed to refrigerant flow. This is most suitable for low temperature applications of the display cabinet 10, such as when displaying frozen food articles. For medium temperature applications of the display cabinet 10, such as displaying meat or the like, defrost of the evaporator 70*a* and 70*b* is accomplished by alternately closing valve 75*a* and 75*b* to prevent flow of refrigerant through only evaporator 70*a* or 70*b* alternately. Thus, when the fan 90 is operated, air flow through the evaporator 70 in which refrigerant flow is prevented will cause that evaporator 70 to be defrosted.

In the alternative embodiment shown in FIG. 3, defrost may be additionally enhanced by selectively operating a fan 90*a* to cause defrost in evaporator 70*a* while maintaining fan 90*b* in a non-operational condition. Defrost of evaporator 70*b* may be accomplished in the same manner by operating fan 90*b* while maintaining the fan 90*a* in a non-operating condition.

It is understood that defrost of the evaporators 70 may be accomplished by the operation of the fans 90 when the refrigeration system is in the non-operating condition, and that the shut off valve 75*a* and 75*b* and the controller 76 are not necessary to the operation of the subject invention, but rather illustrate advantageous methods of defrosting the evaporators 70*a* and 70*b*. Other methods of advantageously causing defrost of the evaporator 70*a* and 70*b* will be readily apparent to those skilled in the art of refrigeration systems.

It is readily apparent that the subject invention offers the advantages of simplicity of construction and operation. The subject invention is also economical in operation, as the multisectional air curtain entrains a relatively smaller amount of environmental air and moisture as compared to a single air curtain flowing from louver 80*a* to 80*b* or vice-versa. This reduces the defrost requirement and increases the relative operational time per cycle. It will be appreciated, that although the design of the refrigeration display case in the subject invention appears relatively straight forward, it provides substantial advantages over the known prior art.

Modifications to the preferred embodiment of the subject invention will be apparent to those skilled in the art within the scope of the claims that follow hereinbelow.

What is claimed is:

1. An island-type refrigeration display cabinet comprised of:

a cabinet having an interior display space therein and a top wall with an access opening therethrough;

means for forceably discharging at least two oppositely directed co-planar convergent air streams into said access opening, said air streams generating a multisectional single air curtain across said access opening, said forceable discharge means further comprises of a bifurcated conduit disposed in said cabinet, said bifurcated conduit including two discharge louvers in parallel spaced relationship, each said louver disposed at a respective side of said access opening for discharging one of said oppositely directed co-planar convergent air streams;

a motor driven fan element disposed in said bifurcated conduit; and means for providing return air to said conduit from said interior display space, said return air means including a plurality of interior walls defining said interior display space, said interior walls having a plurality of return air apertures therethrough, and said return air means further including a return air conduit in said cabinet in flow communication with said return air apertures, said return air conduit having an aperture for flow communication with said bifurcated conduit.

2. An island-type refrigeration display cabinet comprised of:

a cabinet having exterior top, bottom, front and rear walls and an interior display space defined by interior walls having airflow apertures therethrough, said exterior top wall having a front portion, a rear portion, and an access opening for access to said interior display space;

a separation member in spaced relation between said interior walls and said exterior walls to form a first conduit and a second conduit, said second conduit having a first and second bifurcation, said separation member further having an aperture for permitting airflow from said first conduit to said second, bifurcated conduit;

means for forcing air from said first conduit to said second conduit;

means for refrigerating air in at least one of said conduits;

means for directing at least two oppositely directed co-planar convergent air streams into said access opening, said air streams generating a multisectional single air curtain across said top aperture.

3. The island-type refrigeration display cabinet as set forth in claim 2 wherein each said bifurcation of said second conduit is further comprised of a discharge louver discharging one of said oppositely directed co-planar convergent air streams.

4. The island-type refrigeration display cabinet as set forth in claim 3 wherein each said louver is disposed at a respective side of said access opening opposite from the other said louver.

5. The island-type refrigeration display cabinet as set forth in claim 4 wherein said means for refrigerating air is further comprised of:

a first refrigerant evaporator in the first bifurcation of said second conduit;

a second refrigerant evaporator in the second bifurcation of said second conduit;

a refrigerant compressor in flow connection with said evaporators;

a refrigerant condensor for receiving refrigerant from said compressor;

an expansion device for receiving condensed refrigerant from said condensor and directing expanded refrigerant to said first and second evaporators.

6. The island-type refrigeration display cabinet as set forth in claim 5 wherein said means for refrigerating air is further comprised of a control system for selectively causing defrost of one of said refrigerant evaporators.

7. The island-type refrigeration display cabinet as set forth in claim 6 wherein said means for forcing air is further comprised of a motor driven fan element disposed in said aperture between said first conduit and said second conduit.

8. The island-type refrigeration display cabinet as set forth in claim 6 wherein said means for forcing air is further comprised of a motor driven fan element disposed in each bifurcation of said second conduit.

9. An island-type refrigeration display cabinet comprised of:

a cabinet having exterior top wall, front side wall, rear side wall and a bottom wall and an interior display space defined by interior side walls having airflow apertures and an interior bottom panel, said exterior top wall having a front portion, a rear portion, and an access opening for access to said interior display space;

a plurality of intermediate side walls in spaced relation between said interior side walls and said exterior walls, and an intermediate bottom panel in spaced relation between said interior bottom panel and said exterior bottom wall, to form a return air conduit and a bifurcated air supply conduit, said bifurcated air supply conduit having a first and second bifurcation extending along said front wall, said rear wall, and said bottom exterior wall, said separation member further having an aperture for permitting airflow from said return air conduit to said bifurcated air supply conduit;

means for forcing air through said bifurcated air supply conduit;

means for refrigerating air in said bifurcated air supply conduit;

a first louver flowably connected to the first bifurcation of said bifurcated air supply conduit, said first louver discharging a first planar air curtain in said access opening toward said rear portion of said top wall; and a second louver flowably connected to the second bifurcation of said bifurcated air supply conduit, said second louver discharging a second planar air curtain in said access opening toward said front portion of said top wall, said first air curtain and said second air curtain being co-planar and oppositely directed to form a single, multisectional air curtain in said access opening.

10. The island-type refrigeration display cabinet as set forth in claim 9 wherein said means for refrigerating air is further comprised of:

a first refrigerant evaporator in the first bifurcation of said second conduit;

a second refrigerant evaporator in the second bifurcation of said second conduit;

a refrigerant compressor in flow connection with said evaporators;

a refrigerant condensor for receiving refrigerant from said compressor;

an expansion device for receiving condensed refrigerant from said condensor and directing expanded refrigerant to said first and second evaporators.

11. The island-type refrigeration display cabinet as set forth in claim 10 wherein said means for refrigerating air is further comprised of a control system for selectively causing defrost of one of said refrigerant evaporators.

12. The island-type refrigeration display cabinet as set forth in claim 11 wherein said means for forcing air is further comprised of a motor driven fan element disposed in said aperture between said first conduit and said second conduit.

13. The island-type refrigeration display cabinet as set forth in claim 11 wherein said means for forcing air is further comprised of a motor driven fan element disposed in each bifurcation of said second conduit.

14. An airflow circuit for an islandtype refrigeration cabinet comprised of:

a cabinet having exterior front, rear and bottom walls, an interior display space, and an access opening for access to said interior display space, said cabinet further having a bifurcated conduit extending along said front, rear and bottom exterior walls;

a return air conduit disposed in said cabinet having a return air aperture for flow communication with said bifurcated conduit;

a plurality of interior walls having apertures for flow communication from said interior display space to said return air conduit;

a motor driven fan element disposed in said return air aperture; and an air curtain in said access opening, said air curtain discharged in a plane by a first discharge flowably connected to a first bifurcation of said bifurcated conduit and a second discharge flowably connected to a second bifurcation of said bifurcated conduit, said second discharge disposed in a spaced, parallel relationship for directing air toward said first discharge.

* * * * *